United States Patent [19]

Storandt et al.

[11] Patent Number: 4,663,887

[45] Date of Patent: May 12, 1987

[54] APPARATUS FOR CONTROLLING THE CLOSING SEQUENCE OF DOUBLE DOORS

[75] Inventors: Ralf Storandt, Leonberg-Höfingen; Regina Storz-Irion, Stuttgart, both of Fed. Rep. of Germany

[73] Assignee: GEZE GmbH, Leonberg, Fed. Rep. of Germany

[21] Appl. No.: 735,638

[22] Filed: May 20, 1985

[30] Foreign Application Priority Data

Jun. 6, 1984 [EP] European Pat. Off. ..... 05100
Jun. 6, 1984 [DE] Fed. Rep. of Germany ..... 3421042
Mar. 1, 1985 [EP] European Pat. Off. ..... 85102341

[51] Int. Cl.[4] ..... E06B 7/16
[52] U.S. Cl. ..... 49/369
[58] Field of Search ..... 49/369, 367, 368, 366

[56] References Cited

U.S. PATENT DOCUMENTS 2,015,996 10/1935 Eichacker ..... 49/366
3,895,461 7/1975 Maynard, Jr. et al. ..... 49/367
4,429,492 2/1984 Imhoff ..... 49/367

FOREIGN PATENT DOCUMENTS 1533628 6/1968 France ..... 49/367

*Primary Examiner*—Philip C. Kannan

[57] ABSTRACT

An apparatus is described for regulating the closing sequence of double doors, each of which is provided with a floor-mounted door closer. In this arrangement an actuating unit is integrated into the floor-mounted door closer associated with the trailing door and controls a valve unit in the floor-mounted door closer associated with the leading door, preferably via a Bowden cable. The Bowden cable is laid in the ground so that no parts need to be installed on the door or door frame.

12 Claims, 6 Drawing Figures

APPARATUS FOR CONTROLLING THE CLOSING SEQUENCE OF DOUBLE DOORS

Figure 1:
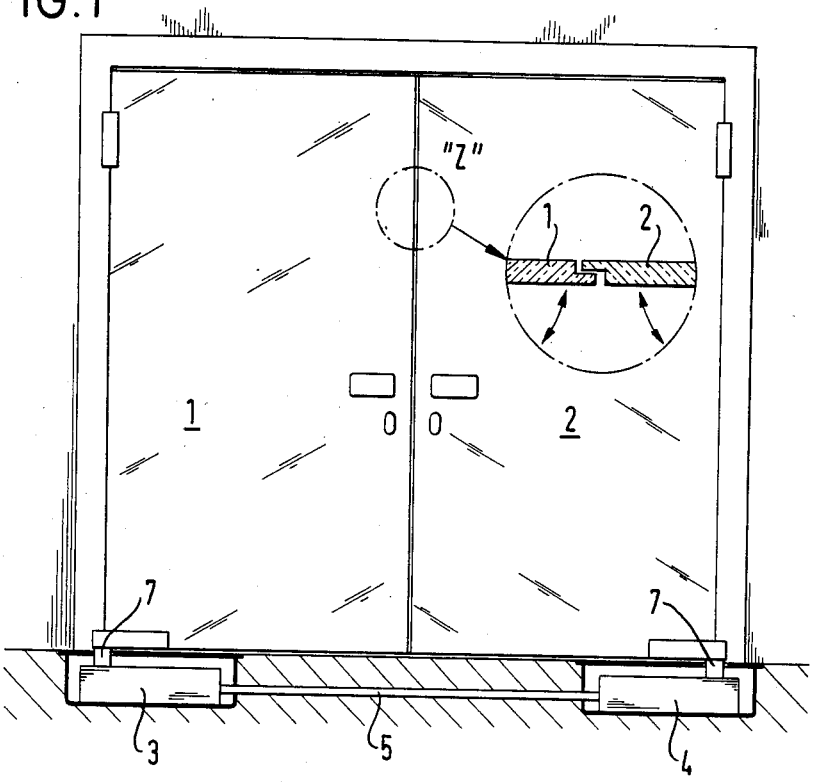

The invention relates to an apparatus for controlling the closing sequence of double doors having one leading door and one trailing door, wherein both the overlapping leading door and also the trailing door are each connected to a floor mounted door closer, and wherein an arrangement is provided which prevents the closing of the leading door when the trailing door is open.

With double doors equipped with floor mounted door closers of the type described in German Auslegeschrift No. 25 35 244 it is customary to provide a mechanical apparatus which is completely separate from the door closers on the upper lintel of the door frame in order to ensure a predetermined closing sequence of the leading and trailing doors.

As a result of their accessibility these known arrangements are permanently exposed to wanton damage which can lead to unfitness for service, and their presence can lead to an aesthetically unsatisfactory appearance of the doors. Moreover, the installation of these known arrangements requires bores in the door lintel which can lead to undesirable weakness, in particular in the case of fire doors.

The principal object underlying the present invention is to construct an apparatus of the initially named kind in a way such that the required closing sequence of the trailing and leading doors is achieved without parts which are visible and exposed to the danger of being damaged, and in a way which minimises the effort and expense involved in installation and which avoids bores which lead to weakening of the door frame.

This object is satisfied, in accordance with the invention, in that an actuating unit which can be switched over between a first state corresponding to the closed position of the trailing door and a second state corresponding to the open position of the trailing door is provided in or on the (cement) box of the closer associated with the trailing door; in that the closer associated with the leading door is equipped with a valve unit for the blocking and release of the closing movement; and in that a mechanical, hydraulic or electrical control connection is provided between the actuating unit of the one closer and the valve unit of the other closer.

These measures provide an integrated closing sequence system for floor-mounted door closers which is not subjected to any danger of wanton damage, which can be installed simply and which does not require any modifications to the door or door frame, so that no mechanical weakening of the frame or door, and also no reduction of the period of fire resistance arises.

In a relatively simple embodiment the actuating unit may consist of a pivoted lever arrangement which is journalled in the cement box and which has an arm which projects into the path of movement of the trailing door.

In accordance with a preferred embodiment of the invention the actuating unit consists of the pressure member which cooperates directly or indirectly with the control cam of the closer and which is subjected to the bias of a spring, and of a draw bar which is coupled with the pressure member via an elongate slot and which is moved by the pressure member over a path which corresponds to a predeterminable range of pivotal movement of the closer starting at the zero position. In this arrangement the draw bar is preferably coaxially arranged in the chamber which accommodates the pressure spring and is led out of this accommodation chamber via a ring seal. This multiple utilisation of parts which are already present in the door closer results in an extremely simple and operationally reliable assembly which is also favourable from a cost point of view.

The valve unit provided in the closer associated with the leading door preferably consists of an axially displaceable piston rod which can sealingly move into a valve bore, wherein the valve bore is a part of the flow path between the pressure fluid chambers disposed on the two sides of the damping piston of the closer. This arrangement is characterised by its compactness and operational reliability.

The piston rod conveniently extends parallel to the axis of the damping piston and is usefully biased into the closed position by means of a pressure spring.

The control connection between the actuating unit and the valve unit preferably consists of a Bowden cable which can be adjusted via an adjustment screw, which is mounted in a wall of the closer and extends in a free space between the closer and the cement box wall. This positioning screw is thus easily accessible and makes problemfree adjustment possible.

A further advantageous embodiment is characterised in that a protective cap is in each case provided at the cement boxes in the region of the point of emergence of the Bowden cable, with the outer ends of the protective caps preferably being connectable with a tube laid in the floor.

Figure 4:
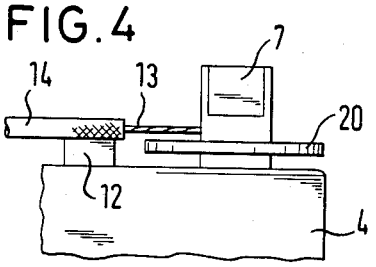
Figure 2:
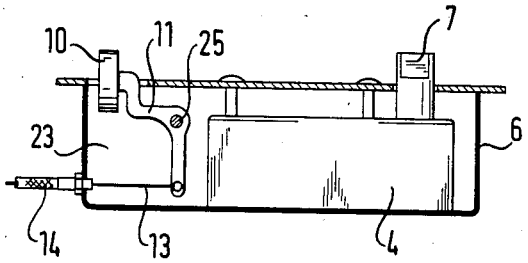
Figure 3:
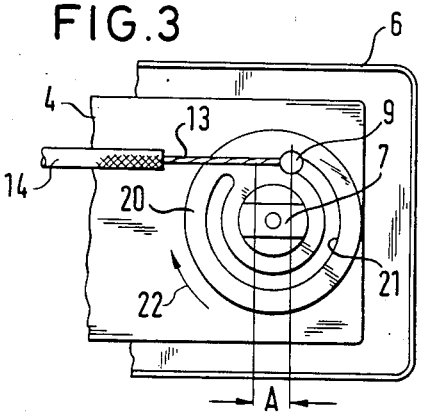
Figure 5:
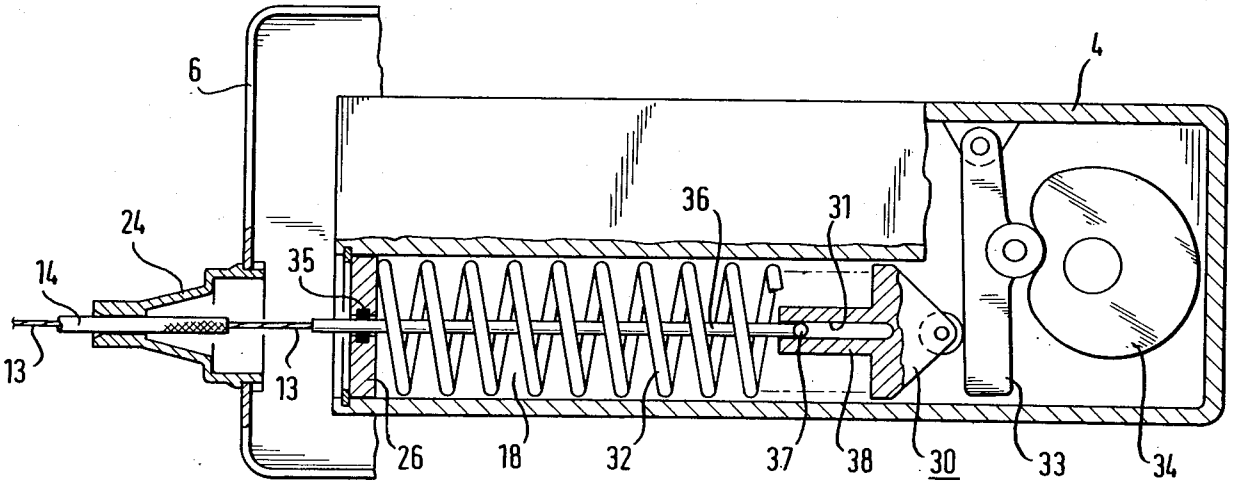
Figure 6:
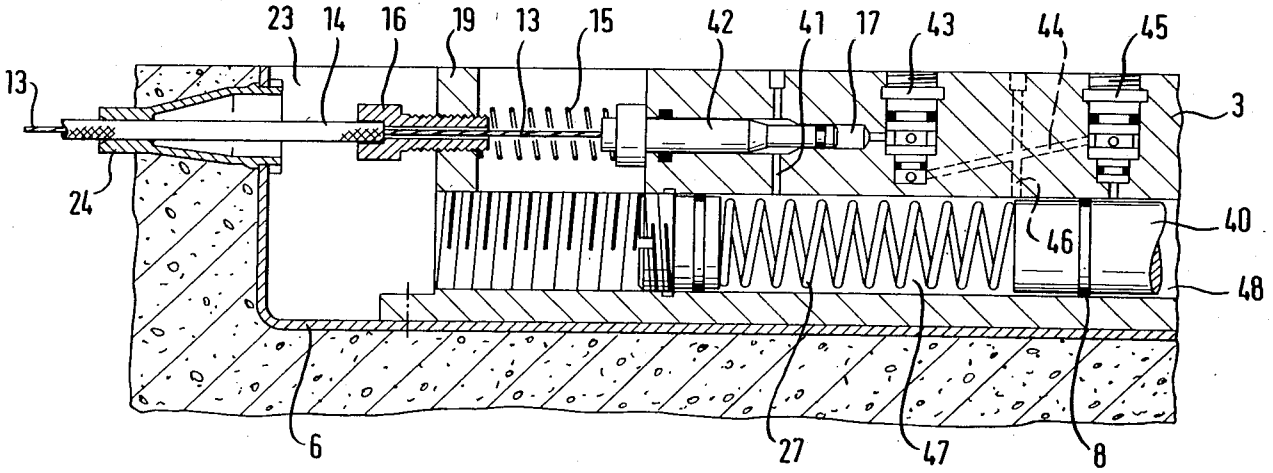

Embodiments of the invention will now be explained in more detail by way of example only and with reference to the drawings which show:

FIG. 1 a schematic illustration of a double door equipped with floor-mounted door closers, FIG. 2 a schematic illustration of a release mechanism housed in the cement box of a door closer, FIG.3 a schematic partial plan view of a floor-mounted door closer with a release mechanism connected to the closer shaft, FIG. 4 a schematic partial side view of the arrangement of FIG. 3, FIG. 5 a schmaticised partial view of a door closer with an integrated release mechanism, and FIG. 6 a schematic part illustration of a floor-mounted door closer arranged in a cement box and having an integrated valve unit for closure control.

FIG. 1 shows the two doors, 1, 2 or a pair of double doors, with the leading door 1 being connected to a floor-mounted door closer 3 via a closer axle 7 and with the trailing door 2 being connected to a floor-mounted door closer 4, likewise via its closer axle 7. A pipe 5 for accommodating a control line is provided between the two floor-mounted door closers 3 and 4.

The detail Z shows the cooperation of the cooperation between the trailing door 2 and the leading door 1 with the corresponding overlap or underlap and this detail Z makes it clear that orderly closing of the double doors is only ensured when the trailing door 2 first moves into the closed position and is then followed by the leading door 1.

FIG. 2 shows a first embodiment of the invention in which a lever 11 pivotable about an axle 25 is provided in the cement box 6 in a free space 23 alongside the closer 4. The pivotable lever 11 is provided with a roller 10 at one end which projects above the upper cover plate of the closure so that the pivotal lever which is pressed downwardly when the door is closed is actuated when the trailing door 2 is swung open. This actuation of the pivotable lever 11 has the consequence that a Bowden cable 13, 14 connected to the other end of the pivotable lever 11 is moved which serves to control a valve unit provided in the other door closer. The release mechanism is accordingly integrated with the door closer in the cement box and is correspondingly simple to install. In place of the release roller one can also use a slide member, a key member or the like.

In the variant illustrated in FIG. 3 a separate release mechanism is no longer provided but instead the closer itself is used to actuate the Bowden cable 13, 14. For this purpose a disk, 20 is rotationally fixedly connected to the closer axle 7. The disk 20 has a part-annular elongate slot 21, and a coupling element 9 which is connected with the core or wire 13 of the Bowden cable engages in the elongate slot 21.

In the illustrated position the closer is in the zero position in which the Bowden cable is pulled by an amount A. The direction of rotation of the closer axle 7 during closing is characterised by the arrow 22. On opening the door connected with the closer the Bowden cable can retract by the amount A. During further opening of the door the coupling element 9 moves in the longitudinal slot 21 without actuating the Bowden cable. Accordingly it is possible to precisely signal the closing state of the trailing door, the consequence of this is to ensure exact control of the leading door.

FIG. 4 shows that the disk 20 for controlling the Bowden cable 13, 14 which is held by means of a support part 12 can be accommodated in a particularly space-saving manner and can accordingly also be used without problems in customary door closers.

FIG. 5 shows a preferred embodiment of the invention in which the closer itself is used to control the Bowden cable 13, 14.

The spring 32 which is shown partly broken away and which is accommodated in a chamber 18 acts on the pressure member 30 which is always provided in the closer and which in turn acts via a lever 33 on the control cam 34 of the closer 4. As a consequence the movement of the pressure member is directly proportional to the door movement. This movement of the pressure member is directly exploited to actuate the Bowden cable 13, 14. The core 13 of the Bowden cable which extends through a protective cap 24 on the cement box 6 is connected with a draw rod 36 which is guided through a closure wall 26 through the intermediary of a ring seal 35 and which engages via a nipple or cross-spin 37 in an elongate slot 31 of the pressure head or bolt 38 which belongs to the pressure member 30. The elongate slot 31 reduces the effective total stroke of the pressure member 30 relative to the Bowden cable in analogous manner to the disk 20 described in conjunction with FIG. 3.

The part-sectional illustration of FIG. 6 shows part of the floor-mounted door closer associated with the leading door in order to explain the release and blocking of the closure movement in dependence on the actuating unit of the other floor-mounted door closer with which the trailing door is associated.

In this drawing the reference numeral 40 represents the customary damping piston which displaces the oil during closing of the door from the damping chamber 47 via a bore 41, a regulating valve 43 and a return bore 46, or via a second bore 44 and a second valve 45, into a chamber 48 disposed on the other side of the piston 40. The pressure chambers disposed on the two sides of the damping piston 40 are separated from one another by a piston seal 8. The return movement of the piston 40 takes place via a spring 27.

The flow path from the bore 41 to the bore 44 or 46 respectively, i.e. the flow path between the pressure chambers disposed on the two sides of the damping piston can be blocked by means of a piston rod 42 which can be sealingly moved into a bore 17 which forms part of the flow path. The position of the piston 42, which is sealed relative to its guide bore, is controlled via the Bowden cable 13, 14 and is connected with the core 13 of the Bowden cable. The piston 42 is biased in the direction of blocking of the flow path by means of a spring 15.

A positioning screw 16 which is screwed into a threaded bore of a fixed wall 19 of the housing and through which the core 13 of the Bowden cable is guided supports the sleeve 14 of the Bowden cable and thus makes it possible to adjust the Bowden cable. As the positioning head of the screw 16 is located in a free space 23 of the cement box 6 the requirement for accessibility is met and the adjustment can be effected without problem.

If the trailing door 2 is closed then the Bowden cable is drawn via the respective actuating unit, i.e. the piston rod 42 is located in the retracted position and the flow passage between the chambers 47, 48 on the two sides of the piston 40 is open. Accordingly the leading door can be closed normally.

If however the trailing door 2 is open the Bowden cable is released and the spring 15 presses the piston rod 42 into the connection bore 17 whereby the flow passage between the chambers 47 and 48 is blocked. Accordingly the piston 40 can no longer move and the closer is fixed or blocked. Only when the trailing door 2 has again reached the closed position is the piston rod 42 drawn out of the connection bore 17 and thus the flow path freed so that the leading door can also be guided into its closed position by means of the closer 3.

We claim:

1. Apparatus for controlling the closing sequence of double doors having one leading door and one trailing door wherein said leading door overlaps said trailing door when said doors are closed; wherein both said leading door and said trailing door are each connected to a respective floor-mounted door closer, each floor-mounted door closer having a respective cement box and mounted therein a damping piston displaceable in a bore to force hydraulic fluid from a first chamber through a passage into a second chamber, said piston being coupled to a closer axle of the respective floor-mounted door closer for damping the closing movement of the associated door; and wherein an arrangement is provided which prevents the closing of the trailing door when the leading door is open, said apparatus further comprising an actuating unit having a first state corresponding to the closed position of the trailing door and a second state corresponding to the open position of the trailing door provided in the box said floor-mounted door closer associated with said trailing door; means for switching over said actuating unit between said first and second states in dependence on the position of said trailing door; a valve unit provided in said floor-mounted door closer associated with said leading door, said valve unit having a valve member operable to selectively block or free the passage of the associated floor-mounted door closer, whereby to block or release the door closing action of that floor-mounted door closer on said leading door; and a control connection provided between said actuating unit of said floor-mounted door closer associated with said trailing door and said valve unit of said floor-mounted door closer associated with said leading door.

2. Apparatus in accordance with claim 1 wherein said floor-mounted door closer cement boxes, said valve unit and said connection are located entirely below an upper surface of a floor.

3. Apparatus in accordance with claim 1, wherein said actuating unit consists of a pivoted lever arrangement which is journalled in said cement box of said floor-mounted door closer associated with said trailing door and which has an arm which projects into the path of movenent of said trailing door.

4. Apparatus in accordance with claim 1, wherein said actuating unit consists of a disk with a part annular elongated slot which is connected with said closer axle of said floor-mounted door closer associated with said trailing door, wherein a coupling element is displaceably journalled in said elongate slot and is pivotable with said disk over a predetermined pivotal range.

5. Apparatus in accordance with claim 1, wherein said floor-mounted door closer associated with said trailing door has a control cam mounted on said closer axle for rotation therewith and a pressure member which cooperates with said control cam and is subjected to the bias of a spring; wherein said pressure member has an elongated slot with first and second ends; and wherein said actuating unit consists of said pressure member, and of a draw bar which is coupled with the pressure member via said elongate slot and which is moved by the pressure member over a path which corresponds to a predetermined range of pivotal movement of the associated closer axle.

6. Apparatus in accordance with claim 5, wherein said draw bar is coaxially arranged in a chamber which accomodates said spring and is led out of this chamber via a ring seal.

7. Apparatus in accordance with claim 1, wherein said valve member consists of an axially displaceable piston rod which can be sealingly moved into a valve bore, said valve bore forming part of said passage between said first and second chambers of said floor-mounted door closer associated with said leading door.

8. Apparatus in accordance with claim 7, wherein said piston rod extends parallel to the axis of the damping piston of the floor-mounted door closer associated with said leading door and is biased into the closed position by means of a pressure spring.

9. Apparatus in accordance with claim 1, wherein said control connection between said acutating unit and said valve unit consists of a Bowden cable.

10. Apparatus in accordance with claim 9, wherein said Bowden cable can be adjusted via an adjustment screw which is mounted in a wall of the floor-mounted door closer associated with said leading door said closer and the associated cement box.

11. Apparatus in accordance with claim 9, wherein a protective cap is provided at each of said cement boxes in the region of the point of emergence of said Bowden cable.

12. Apparatus in accordance with claim 11, wherein said protective caps have outer ends and wherein a tube for sad Bowden cable is laid between said cement boxes and is connected to said outer ends of said protective caps.

* * * * *